US010253580B2

(12) United States Patent
Imbault

(10) Patent No.: US 10,253,580 B2
(45) Date of Patent: Apr. 9, 2019

(54) DEVICE FOR CONTROLLING A BRAKE OF A WINCH DRUM MOUNTED ON A DRILLING RIG AND METHOD FOR CONTROLLING SUCH A DEVICE

(71) Applicant: AUTELEC, Mennecy (FR)

(72) Inventor: Bernard M Imbault, Mennecy (FR)

(73) Assignee: AUTELEC, Mennecy (FR)

( * ) Notice: Subject to any disclaimer, the term of this patent is extended or adjusted under 35 U.S.C. 154(b) by 321 days.

(21) Appl. No.: 15/024,370

(22) PCT Filed: Sep. 16, 2014

(86) PCT No.: PCT/EP2014/069698

§ 371 (c)(1),
(2) Date: Jun. 30, 2016

(87) PCT Pub. No.: WO2015/044004

PCT Pub. Date: Apr. 2, 2015

(65) Prior Publication Data

US 2016/0305198 A1 Oct. 20, 2016

(30) Foreign Application Priority Data

Sep. 24, 2013 (FR) ..... 13 59187

(51) Int. Cl.

| | |
|---|---|
| ***E21B 19/00*** | (2006.01) |
| ***B66D 5/10*** | (2006.01) |
| ***B66D 5/30*** | (2006.01) |
| ***E21B 19/08*** | (2006.01) |
| ***E21B 3/04*** | (2006.01) |

(52) U.S. Cl.

CPC ..... *E21B 19/008* (2013.01); *B66D 5/10* (2013.01); *B66D 5/30* (2013.01); *E21B 3/04* (2013.01); *E21B 19/08* (2013.01)

(58) Field of Classification Search

CPC ..... E21B 19/008; E21B 19/08; E21B 3/04; B66D 5/10; B66D 5/30

See application file for complete search history.

(56) References Cited

U.S. PATENT DOCUMENTS

| | | | | |
|---|---|---|---|---|
| 1,805,808 A | | 5/1931 | Crum | |
| 2,117,078 A | | 5/1938 | Brauer | |
| 2,658,589 A | * | 11/1953 | Ashton | B66D 5/00 188/105 |
| 2,842,339 A | | 7/1958 | Gresham et al. | |

(Continued)

FOREIGN PATENT DOCUMENTS

| | | |
|---|---|---|
| EP | 0694114 B1 | 10/2002 |
| GB | 542928 A | 2/1942 |

(Continued)

*Primary Examiner* — Michael E Gallion

(74) *Attorney, Agent, or Firm* — Bachman & LaPointe, P.C.

(57) ABSTRACT

A device for controlling a brake of a drum of a draw-works equipping a drilling rig operating a drill tool in a borehole, which device comprises a brake lever having a first end connected mechanically to brake bands designed to act on the drum and a second end provided with a first brake control handle. The device further comprises actuation means configured to be controlled and arranged to act mechanically on the brake lever, and a second brake control handle arranged to servo-control said actuation means.

14 Claims, 3 Drawing Sheets

(56) References Cited

U.S. PATENT DOCUMENTS 3,031,169 A * 4/1962 Robinson ..... E21B 19/08 173/5
3,101,828 A * 8/1963 Wilson ..... E21B 19/02 192/139
3,373,823 A * 3/1968 Benner ..... E21B 19/08 173/6
3,627,084 A * 12/1971 Benedek ..... F16D 49/08 188/105
3,759,489 A * 9/1973 Jones ..... E21B 19/08 173/6
4,046,355 A * 9/1977 Martin ..... B66D 1/50 254/273
4,177,973 A * 12/1979 Miller ..... B66D 1/54 188/170
4,187,546 A 2/1980 Heffernan et al.
4,434,971 A 3/1984 Cordrey
4,662,608 A * 5/1987 Ball ..... E21B 44/00 175/162
4,696,377 A * 9/1987 Richardson ..... B66D 5/14 188/151 R
5,425,435 A * 6/1995 Gregory ..... B66D 5/14 188/264 A
5,474,142 A * 12/1995 Bowden ..... E21B 44/02 175/162
5,671,912 A * 9/1997 Langford ..... B66D 1/54 188/77 R
7,044,239 B2 * 5/2006 Pinckard ..... E21B 44/005 175/24
7,059,427 B2 * 6/2006 Power ..... E21B 19/08 175/27
7,185,881 B2 3/2007 Drarvik et al.
7,537,066 B1 * 5/2009 Flud ..... E21B 44/02 175/122
8,727,038 B2 * 5/2014 Chan ..... E21B 44/02 166/75.11
9,815,671 B2 * 11/2017 Nield ..... B66D 5/10
9,902,598 B2 * 2/2018 Zhang ..... B66D 5/08
2004/0226748 A1 * 11/2004 Prior ..... E21B 19/008 175/27
2010/0252345 A1 * 10/2010 Hoshino ..... B60L 7/18 180/65.31
2011/0174538 A1 * 7/2011 Chan ..... E21B 19/08 175/24
2016/0305198 A1 * 10/2016 Imbault ..... B66D 5/10

FOREIGN PATENT DOCUMENTS

GB 631034 A 10/1949
GB 842435 A 7/1960
WO 2011129705 A1 10/2011

* cited by examiner

DEVICE FOR CONTROLLING A BRAKE OF A WINCH DRUM MOUNTED ON A DRILLING RIG AND METHOD FOR CONTROLLING SUCH A DEVICE

BACKGROUND

The present invention relates to a device and a method for controlling a brake for a drilling rig, and to an automatic drilling system implementing such a device.

The invention relates more particularly to the field of petroleum drilling of the "rotary table" type and/or of the "top drive" type. A "rotary table" system usually includes an injection head, a pull rod or kelly that passes through a rotary table and that is connected to a string of drill-pipes or "drill string", and, at the end of the string, a drill tool or "drill bit" that cuts into the ground. The kelly, and therefore the drill string and the drill tool at the end of the string are all subjected to rotation via the rotary table and via an angular section of the string that is situated at the table, or, if the table does not constitute the means for rotating the drilling machinery, via the injection head that also serves to drive the string. The invention could also be applied to the field of geothermal drilling.

On a drilling rig, the drill string, which, at its bottom end, is provided with the drill tool, is hooked onto a drill hook, movement of which is controlled by a drilling draw-works or winch. The drilling draw-works includes a brake for preventing the cable from unwinding from the draw-works in an untimely manner. The operator or "driller" uses a device referred to as a "brake control" for controlling loads or tools lowered into the borehole or "well". The brake control thus makes it possible to control the speed and deceleration of the drill hook, optionally to the extent of stopping it from moving.

On a majority of drilling rigs, the brake is a mechanical brake having bands. Such a brake is made up of two metal bands equipped with internal linings fastened by flush-head or "countersunk-head" copper or aluminum bolts. Those bands are connected together by a balancing bar that also distributes the braking force between the two bands, thereby reducing the wear on the brake shoes or "brake pads". Each band wraps around a respective rim constrained to rotate with the drum. One end of each band is stationary, while the other end is connected via a set of cams and connection rods to a hinged lever (the brake control), thereby making it possible to gear down the force to be exerted on its end.

On other drilling rigs, the brake is a disk brake. In which case, the brake control is implemented in the form of a joystick.

Whether it be via use of a brake control in the form of a hinged lever or "brake lever", or in the form of a disk brake, manual control of the brake control by the driller can give rise to lack of accuracy in actuation of the brake control, which can lead to under-efficiency of the progress of the drilling and to premature wear on the drill tool. An error by the driller can lead to the drill tool being destroyed, or to the well being lost.

Since the constitution of the ground varies over any given drilling stage, manual control of a brake control requires constant attention, which, for example, constitutes a safety problem due to the human factor. An object of the invention is thus to propose a device and a system, as well as a method, for automating the brake control.

Document U.S. Pat. No. 4,187,546 discloses a drum brake including a primary brake whose function is to control the speed and the deceleration of a traveling block of the draw-works, and to stop it from moving. That primary brake is a drum brake that can be actuated manually via a brake control. In addition, that document discloses a return spring that urges the drum brake back into the braking position. That document teaches that the spring can be overridden manually so as to release the brake. It discloses that the lever may be connected to a brake actuator comprising a cylinder provided with a piston. Injecting fluid into the cylinder moves the piston, thereby causing the brake control to move to modulate the force on the brake. The force exerted by the piston on the brake control must exceed the return force of the spring. Emergency braking takes place by emptying the fluid contained in the cylinder into the atmosphere, thereby causing the piston to descend into the cylinder and then the brake control to be urged back by the return spring. It should be noted that such emptying of the fluid contained in the cylinder can give rise to risks of pollution and can be toxic.

Document EP 0 694 114 also discloses a primary brake in the form of a band brake that is, a priori, manually actuatable by a brake control. That document discloses an additional return spring that urges the band brake into the braking position and that can be overridden manually for releasing the brake. The lever may be connected to a brake actuator assembly. More precisely that brake actuator assembly comprises a lift unit connected to a lift line or cable for pulling on the end of the brake control to modulate the force on the brake. Thus, the function of the lift unit is to oppose the return force of the spring and thus to allow the drilling draw-works to descend. For this purpose, the force exerted by the lift unit on the brake control must exceed the return force exerted by the spring on the brake control.

A first drawback with such brake devices is that they have reactivity characteristics that are difficult to make compatible with the numerous variations in the ground that can require very quick reactions, such as when drilling through an influx or encroachment of fluid in the borehole requiring almost instantaneous stopping. In addition, if the spring breaks, the drill hook and its load descend unbraked, with disaster ensuing.

Another drawback with such devices is that the additional spring is dimensioned to exert a return force that is sufficient to withstand the maximum weight that is implemented when the drilling is at its deepest possible. This implies that the largest force for countering that return force and for allowing the brake to descend is implemented at the start of drilling. That implies forces that are very high in the early stages of drilling. The deeper the borehole and the drilling become, the lower the force necessary for releasing the brake. That can give rise to safety problems for very deep drilling.

Another drawback with such devices is that they require the brake control to be equipped with more than one instrument. Unfortunately, a control cabin for a driller is often a very confined space. An object of the invention is thus to propose a device that is more compact than the prior art devices. Another object of the invention is to propose a brake actuator device that is faster, more accurate, and safer during braking and more particularly during emergency braking.

Another problem-solving object of the invention is to install a device that is transparent when used by the site manager, i.e., that requires less learning by the site manager about how the device operates. Another problem-solving object of the invention is to propose a device arranged to operate in co-operation with the driller.

SUMMARY

The invention makes it possible to achieve at least one of the objects by providing a device for controlling a brake of a drum of a draw-works equipping a drilling rig operating a drill tool in a borehole, which device comprises a brake lever having a first end connected mechanically to brake bands designed to act on the drum and a second end provided with a first brake control handle. The brake lever may be implemented in the form of a hinged lever.

In accordance with the invention, the device further comprises actuation means configured to be controlled and arranged to act mechanically on the brake lever, and a second brake control handle arranged to servo-control the actuation means.

The phrase "acting mechanically on the brake lever" is used to mean acting actively rather than passively on the brake lever, in the direction corresponding to the brake bands being used to brake the drum. Thus, the mechanical action on the brake lever exerted by the brake control device is not of the same nature as the mechanical action exerted by a spring. The mechanical action of a spring on the brake lever is passive, because it depends only on the elongation and on the stiffness of the spring.

In accordance with the invention, the mechanical action exerted by the brake control device is active.

Thus, the actuation means are arranged to act actively on the brake lever at least so that the brake bands partially prevent the drum from rotating. Preferably, the actuation means are arranged to act actively on the brake lever at least so that the brake bands fully or partially prevent rotation of the drum.

Preferably, the actuation means are arranged to act actively on the brake lever so that the brake bands partially prevent and/or allow rotation of the drum. Preferably, the actuation means are arranged to act actively on the brake lever so that the brake bands fully or partially prevent and/or allow rotation of the drum.

The actuation means are configured to be controlled to act on the brake lever at least in the direction corresponding to the brake bands being used to brake the drum. Thus, the mechanical action on the brake lever exerted by the brake control device is not of the same nature as the mechanical action exerted by a spring. The mechanical action of a spring on the brake lever is not controlled, because it depends only on the elongation and on the stiffness of the spring.

Thus, the actuation means are controlled to act in accordance with a command on the brake lever at least so that the brake bands partially prevent the drum from rotating. Preferably, the actuation means are arranged to act in accordance with a command on the brake lever at least so that the brake bands fully or partially prevent rotation of the drum.

Preferably, the actuation means are arranged to act in accordance with a command on the brake lever so that the brake bands fully or partially prevent and/or allow rotation of the drum. Even more preferably, the actuation means are arranged to act in accordance with a command on the brake lever so that the brake bands fully or partially prevent and/or allow rotation of the drum.

Preferably, the actuation means are arranged to act on the brake control lever in symmetrical manner, i.e. they are suitable for delivering one action in the braking direction in which the brake bands brake and a symmetrical action in the releasing direction in which the brake bands are released.

The actuation means thus procure automatic control of the brake control device. The actuation means thus procure automatic control of the brake lever. The second control handle may be sensitive, i.e. it may be provided with a sensitive sensor. Alternatively or in addition, the control device may be provided with a strain sensor for measuring strain on the second control handle. Said strain sensor may, for example, be implemented by a strain gauge.

Advantageously, the control device may further comprise electronic means configured to control the actuation means, on the basis of a control signal emitted by the second brake control handle and/or of information on weight conditions to which the drill tool is subjected. The information on the weight conditions to which the drill tool is subjected may be replaced or supplemented with information on conditions of differential mud pressure at the tool, and/or on conditions of maximum torque in rotation withstood by the drill tool, and/or on conditions of maximum speed of penetration into the ground, and/or on operating conditions of the draw-works. An operating condition of the draw-works is, for example, the instantaneous speed of rotation of the draw-works.

In other words, the second control handle is configured to emit a signal referred to as the "handle control signal".

In more advantageous manner, the second control handle may be provided with and/or incorporate an extensometer sensor arranged to generate a handle control signal sensitive to the pressure exerted on the second handle by the hand of an operator.

Alternatively or in addition, the second control handle may be provided with a strain sensor arranged to generate a handle control signal that is sensitive to a force exerted on the second handle by the hand of the operator.

The hand of an operator may advantageously be replaced by any article arranged to exert a force and/or a pressure on the second control handle. For example, such an article may be a remotely controlled actuator.

Preferably, the electronic control means are arranged to servo-control the actuation means to a setpoint thrust force in a braking mode. The braking mode is naturally defined as an operating mode of the device of the invention in which mode the brake bands acting on the drum exert a braking force. In this embodiment, the device of the invention partially prevents rotation of the drum. The braking force may be such that rotation of the drum is stopped.

Advantageously, the electronic control means may also be arranged to servo-control the actuation means to a setpoint position of the brake lever.

Advantageously, the electronic control means may also be arranged to servo-control the actuation means to a setpoint speed of movement of a predefined point of the brake lever. Speed servo-control enables the operator to feel sensations close to those felt under manual drilling conditions.

Preferably, the actuation means are powered via an uninterruptible power supply including power supply interruption detection means, the electronic means being configured to control the actuation means to actuate them in the braking direction when a power supply interruption is detected by the power supply interruption detection means. The braking direction is naturally the direction in which the device of the invention partially prevents rotation of the drum.

Preferably, some or all of the various means of the invention are arranged to operate fully electrically. Thus, for example and preferably, the actuation means are controlled electrically rather than pneumatically.

Preferably, the actuation means are arranged so that, when the brake lever is in a given position, the braking force applied by said actuation means increases when the force exerted by the drill tool on the cable wound on the draw-works increases.

Preferably, the actuation means comprise an electric actuator.

Advantageously, the actuation means may comprise a torque motor.

In another aspect of the invention, it provides a method of controlling a brake control for controlling a brake of a drum of a draw-works equipping a drilling rig operating a drill tool in a borehole, which method implements a brake control of the invention comprising a brake lever having a first end connected mechanically to brake bands designed to act on the drum and a second end provided with a first brake control handle, said method being characterized in that it comprises applying a mechanical force to the brake lever, the applied force being controlled to procure servo-control of the position of the brake lever and/or of a thrust force exerted on the brake lever.

Advantageously, the method of the invention further comprises generating a control signal for servo-controlling the position and/or the thrust force, on the basis of a second control handle disposed substantially at the second end of the brake lever. In addition or alternatively, the servo-control of the control lever may be implemented to servo-control the speed of movement of a predefined point of the brake lever. Speed servo-control enables the operator to feel sensations close to those felt under manual drilling conditions.

Preferably, the servo-control of the brake lever is procured by an actuator controlled from an electronic control unit arranged to process the control signal generated on the basis of the second control handle and/or of the information relating to the operating conditions of the draw-works.

Advantageously, the information processed by the electronic control unit may comprise information relating to the weight applied to the drill tool.

Advantageously, the information processed by the electronic control unit may comprise information on the differential mud pressure at the drill tool.

Advantageously, the information processed by the electronic control unit may comprise information on the maximum torque in rotation withstood by the drill tool.

Advantageously, the information processed by the electronic control unit may comprise information on the maximum speed of penetration of the drill tool into the ground.

BRIEF DESCRIPTION OF THE DRAWINGS

Other advantages and features of the invention appear on reading the following detailed description of embodiments and implementations that are in no way limiting, and on observing the following accompanying drawings.

DETAILED DESCRIPTION

Since these embodiments are in no way limiting, it is possible, in particular, to consider variants of the invention that have only a selection of characteristics described below that are isolated from the other characteristics described (even if the selection is isolated within a sentence including said other characteristics), if the selection of characteristics is sufficient to impart a technical advantage or to distinguish the invention from the prior art. The selection includes at least one preferably functional characteristic without structural details, or with only a fraction of the structural details if that faction is sufficient to impart a technical advantage or to distinguish the invention from the prior art.

In the figures, an element appearing in more than one figure is given the same reference in every figure in which it appears.

Figure 1:
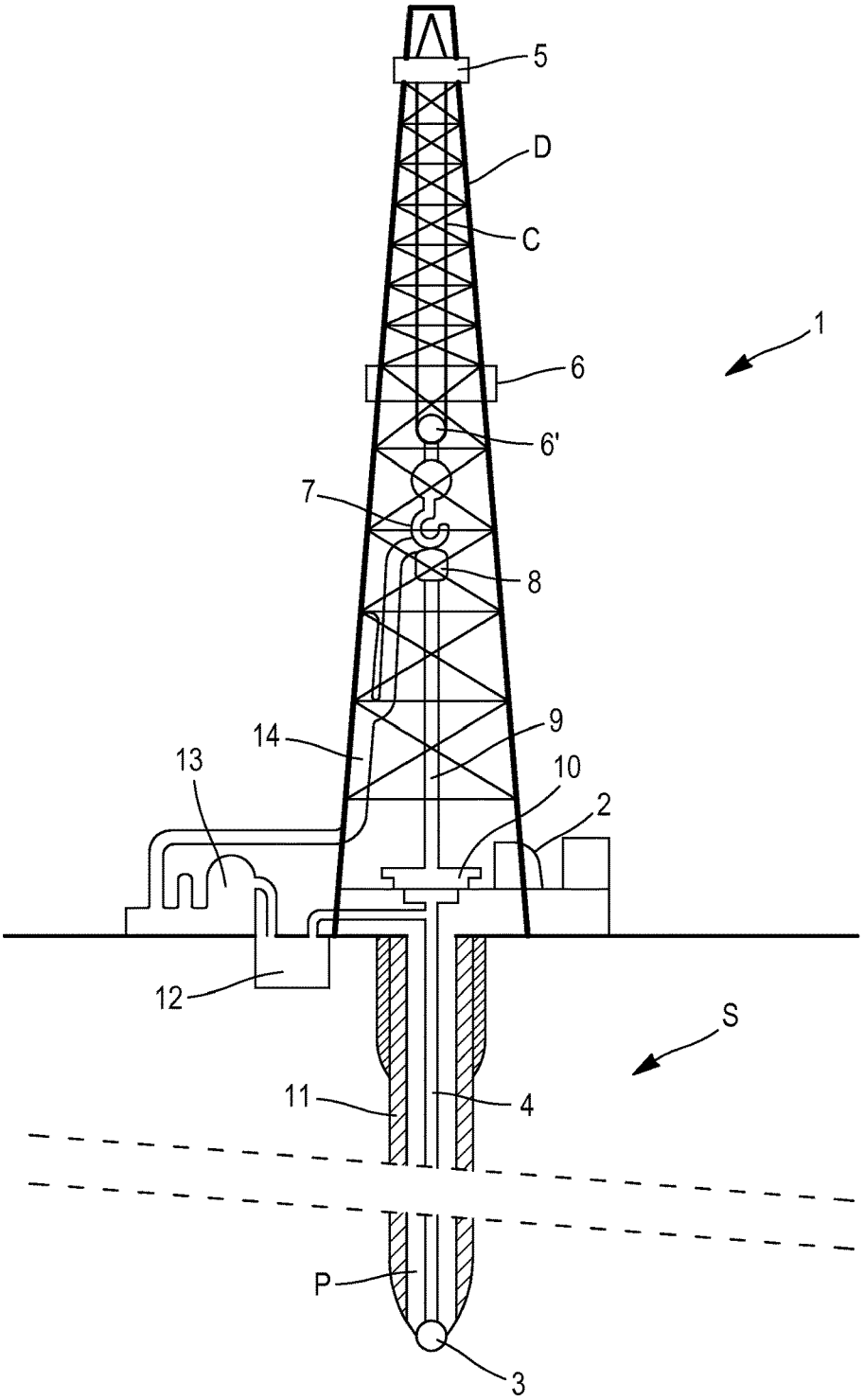
FIG. 1 is a diagrammatic view of a drilling rig of the "rotary table" type.

FIG. 1 shows a drilling rig that is a metal tower having a height of about thirty meters and that serves to insert the drill bits.

This drilling rig 1 includes a derrick D making it possible, via a block system and via a drilling draw-works 2, to perform operations for replacing worn borebits 3, for example, for replacing a string of drillpipes or "drill string" 4 over a certain height, and for storing the drill string element-by-element.

The block system is constituted by a crown block 5 that is mounted to be stationary on the small base of the derrick D, by a traveling block 6, and by a cable C. The crown block 5, i.e. the stationary block, is made up of a certain number of pulleys, all of which are on the same axis. The traveling block 6, i.e. the moving block, has one less pulley than the crown block 5. The traveling block 6 is balanced in such a manner as to make high descent speeds possible. A hoist hook is suspended from the loop 6' of the traveling block 6. The hoist hook 7 can swing freely about a horizontal fixed pin to which the arm of the suspension loop comes to fit.

The drilling rig 1 has a mud injection head 8, and a pull rod or "kelly" 9. The kelly 9 passes through a rotary table 10 and is connected to the drill string 4.

At the end of the string, the drill tool 3 cuts into the ground. The drill tool 3 may also be referred to as the "bit" or as the "borebit". It is the drill collars, screwed on above the drill tool that bear down on it; these drill collars, extend to the surface by pipes, constitute the drill string or string of drill-pipes 4. The drill collars are pipes that are heavy and that are stronger than the pipes making up the remainder of the drill string 4. They are placed directly above the borebit 3. Their purpose is to press the drill tool 3 against the bottom of the borehole or well P, and to prevent the ordinary pipes from being subjected to compression during the drilling work, because they are much weaker and therefore much less capable of withstanding massive flexion and traction forces, thereby limiting the risks of breakage and reducing the friction on the walls of the borehole P.

The pull rod or kelly 9, and therefore the drill string 4 and the tool 3 at the end of the string, are subjected to rotation via the rotary table 10 and via an angular section of the string that is situated at the rotary table 10.

In another embodiment, if the rotary table 10 is not the means for rotating the drilling machinery, the kelly 9, and therefore the drill string 4 and the drill tool 3 at the end of the string, are subjected to rotation via the injection head 8 that also serves to drive the string 4.

The drill string 4, which, at its bottom end, is provided with the drill tool 3, is hooked onto the hoist hook 7, movement of which is controlled by the drilling draw-works 2.

The drill tool 3 is provided with teeth that cut into the rock of the ground S by turning at high speed, thereby grinding it into small pieces.

To prevent the borehole from collapsing, a casing 11 is laid. The casing 11 is made up of tubular elements or pipes that retain the inside wall of the borehole P. The casing elements line said wall and are fastened by cementing. The casing elements descend under their own weight and their diameters decrease with increasing depth. A first casing pipe is laid as soon as the drill tool 3 has drilled through the surface soil, and it is cemented into the hole by cement. A base casing element is fastened to the end that is flush with the surface. All of the following casing pipes are also cemented at their bases and their upper ends are suspended from the base casing element.

After casing the first drilling phase, drilling is continued with a tool 3 of diameter smaller than the inside diameter of the casing string.

Mud is taken from a mud pit or mud tank 12, pumped by a mud pump 13, and sent via a mud line or mud hoses 14 to the mud injection head 8. The mud injection head 8 injects mud into the drill string 4.

The mud lubricates and cleans the drill tool 3. The mud pressure also helps to cut into the rock of the ground S. It prevents the borehole P from collapsing by filling the space between the drill string 4 and the casing 11, and also makes it possible to bring the cuttings generated by the drill tool 3 back up. The mud and the cuttings are brought back up the borehole P, through vibrating screens that separate the mud from the cuttings. The separated mud returns to the mud pit 12. The mud is generally made up of water and of clay, and its composition varies as a function of the ground through which the borehole is cut.

Figure 2:
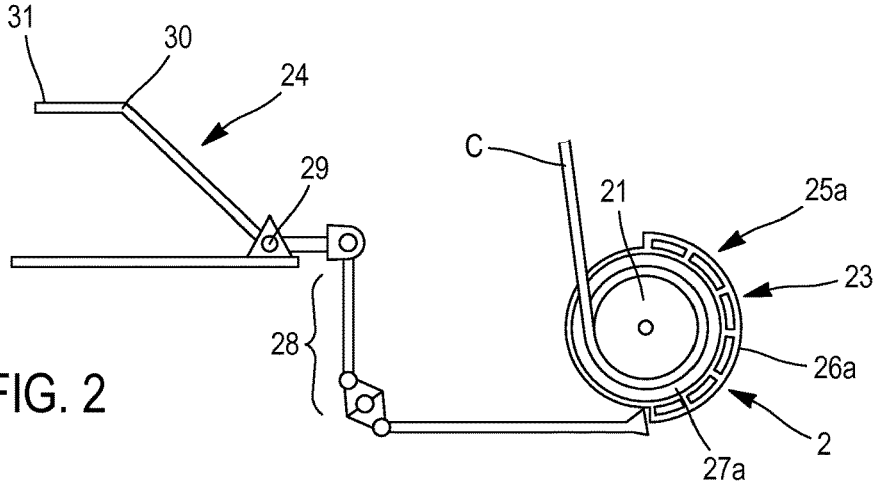
FIG. 2 is a diagrammatic view of a lever and of a draw-works used on the drilling rig, seen looking along a longitudinal axis.
Figure 3:
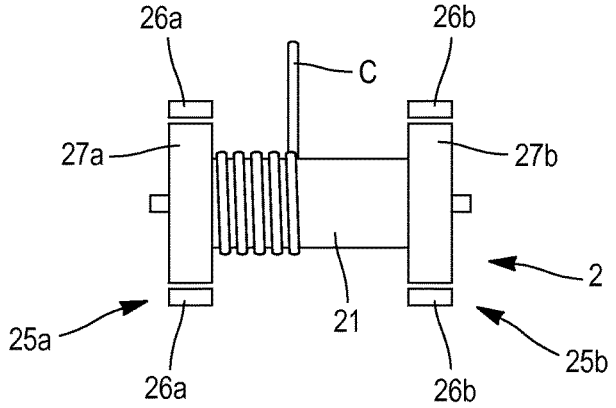
FIG. 3 is a diagrammatic view of the draw-works, seen looking along a vertical axis.

FIGS. 2 and 3 show the drilling draw-works 2 of the drilling rig 1 in more detail. The drilling draw-works 2 comprise a drum 21 on which the draw-works cable C is wound. The drilling draw-works 2 further comprises a brake 23 for preventing the cable C from unwinding from the draw-works. It further comprises a brake control 24 or "brake lever" 24, for controlling loads or tools lowered into the borehole P. The brake control 24 thus makes it possible to control the speed and deceleration of the hoist hook 7, optionally to the extent of stopping it from moving. The brake 23 is a mechanical brake having brake bands 25*a*, 25*b*. This brake 23 is made up of two metal bands (not shown) equipped with internal linings 26*a*, 26*b*. Each band wraps around a respective rim 27*a*, 27*b* constrained to rotate with the drum 21. One end of each band is stationary, while the other end is connected via a set of cams and connection rods 28 to one end 29 of the hinged lever 24 (the brake control 24), thereby making it possible to gear down the force to be exerted on the other end 30 of the brake control 24.

Figure 4:
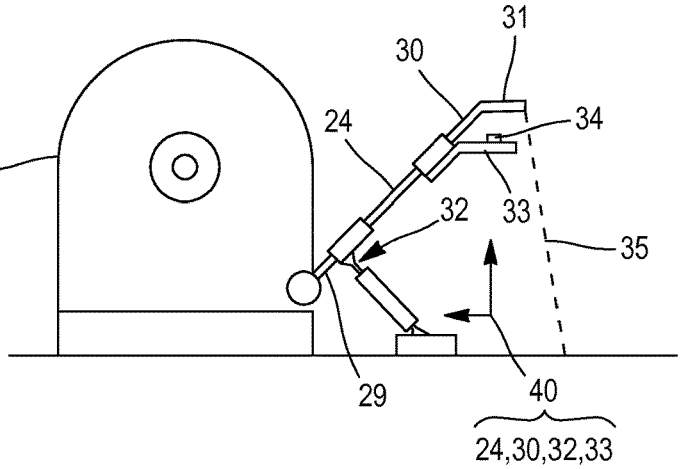
FIG. 4 is a diagrammatic view of a portion of a brake control device of the invention.

FIG. 4 shows an embodiment of a device 40 of the invention. The brake control or brake lever 24 is shown as above.

The brake lever 24 has its first end 29 connected mechanically to the brake bands 25*a*, 25*b*, which are designed to act on the drum 2, and has its second end 30 provided with a first control handle 31 for controlling the brake 23. The brake lever 24 is implemented in the form of a hinged lever. The first control handle 31 is used by an operator to control loads and tools lowered down the borehole P during drilling.

The control device 40 also includes actuation means 32. The actuation means 32 are configured to be controlled and arranged to act mechanically on the brake lever 24. The actuation means are implemented in the form of an electric actuator or "jack", or in the form of a torque motor.

The control device 40 also includes a second brake control handle 33 arranged to servo-control the actuation means 32. The actuation means 32 thus procure automatic control of the brake control device 40 for controlling the brake 23.

The actuation means 32 thus procure automatic control of the brake lever 24. The second control handle 33 is sensitive, i.e. it includes a sensitive sensor 34.

FIG. 4 also shows a metal chain 35 enabling the operator to leave the work station. When said metal chain is disposed between the brake lever 24 and the floor on which the draw-works 2 stands, the brake 23 prevents any unwinding of the cable C from the draw-works 2. The mounting of the additional or second brake control handle 33 does not prevent the metal chain 35 from being put in place to lock the brake 23 mechanically.

A major advantage of this device is that the actuation means 32 are arranged so that, when the brake lever 24 is in a given position, the braking force applied by the actuation means 32 increases when the force exerted by the tool 3 on the cable C wound on the draw-works 2 increases.

Figure 5:
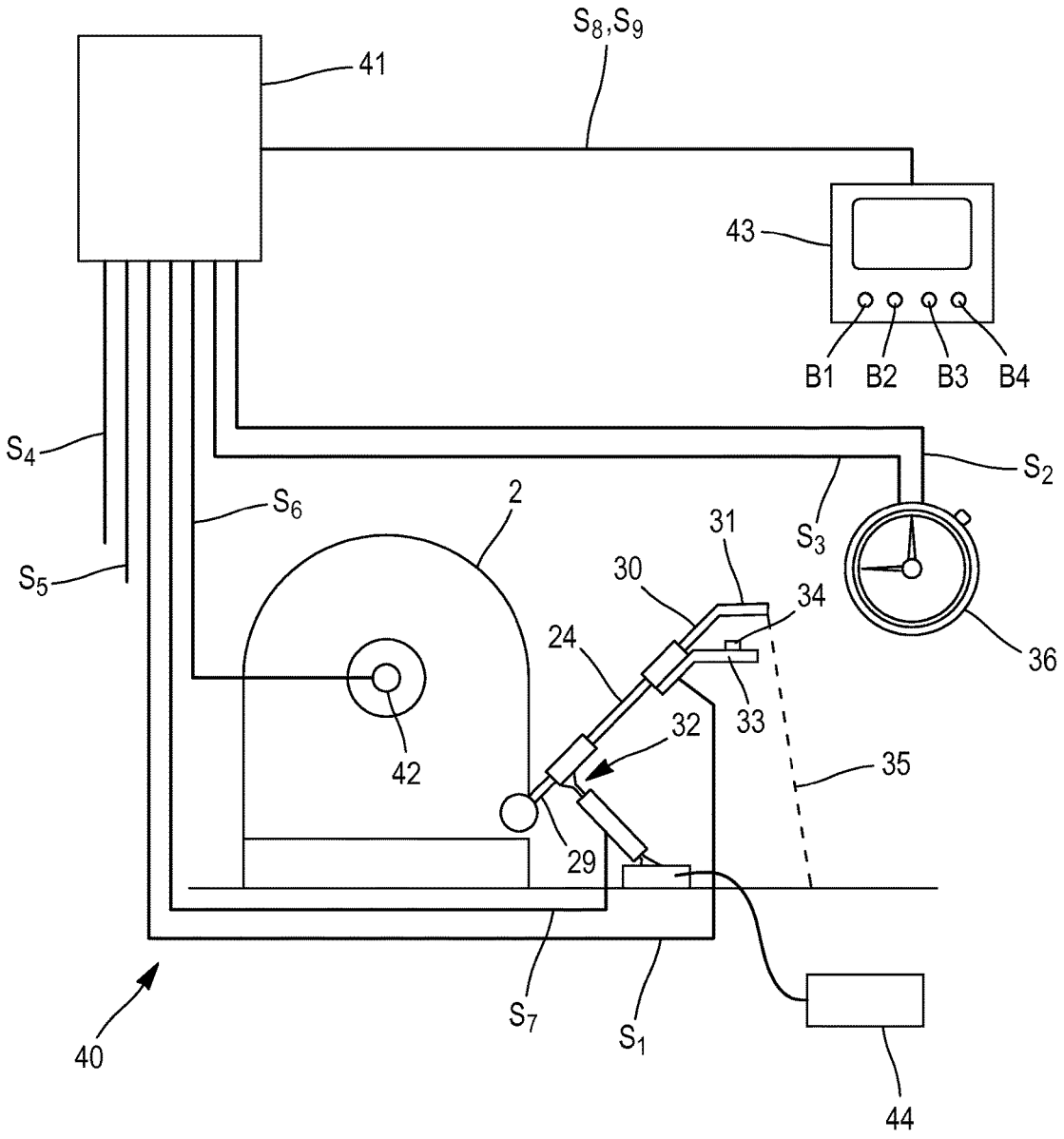
FIG. 5 is a diagrammatic view of a portion of the brake control device of the invention.

With reference to FIG. 5, other aspects of the control device 40 are described below. All of the elements shown in FIG. 4 are also shown in FIG. 5.

The second control handle 33 includes and incorporates the extensometer sensor 34. This sensor is arranged to generate a handle control signal S1 relating to the pressure exerted on the second handle 33 by an operator's hand.

The control device 40 includes electronic means 41. The electronic means 41 are implemented in the form of a central processing unit. These electronic means 41 are configured to control the actuation means 32 on the basis of:

- the control signal S1 emitted by the second brake control handle 33, and referred to as the "handle signal"; and/or
- information on the weight conditions to which the tool 3 is subjected and which are measured by signals S2 and/or S3 emitted by a hydraulic indicator or gauge 36; and/or
- a differential mud pressure at the tool 3, as measured by a signal S4; and/or
- a signal S5 indicating the maximum torque withstood by the tool 3 in rotation; and/or
- the maximum speed of penetration of the tool 3 into the ground S, as measured by a signal S6 by means of a digital sensor 42 mounted on the axle of the drum of the draw-works 2.

The electronic control means 41 control the actuation means 32 by using a control signal S7.

In accordance with the invention, the mechanical action exerted by the brake control device is active.

The actuation means 32 are arranged to act actively on the brake lever 24 so that the brake bands 25*a*, 25*b* fully or partially prevent and/or allow rotation of the drum.

The actuation means 32 are arranged to act in accordance with a command on the brake lever 24 so that the brake bands 25*a*, 25*b* fully or partially prevent and/or allow rotation of the drum.

The actuation means are arranged to act on the brake control lever 24 symmetrically, i.e. they are suitable for delivering an action in the braking direction for braking the drum 21 and a symmetrical action in the releasing direction for releasing the drum.

The second control handle 33 thus makes it possible to measure the force of the hand of the operator and its direction so as to servo-control the movements and the thrust force of the actuation means 32 on the brake lever 24.

A major advantage of this device is that it can be readily installed on all manual drilling rigs designed with draw-works having a brake associated with a manual control lever, with a minimum of mechanical mounting and assembly, and without affecting the structural integrity of the initial component elements of the draw-works.

The hydraulic indicator 36 is instrumented to deliver two electrical signals S2 and S3 for indicating respectively the weight suspended on the hoist hook 7 and the weight applied to the tool 3. In a variant of this embodiment, the weight suspended on the hoist hook 7 and the weight applied to the tool 3 are known by placing a pressure sensor on the hydraulic portion of the indicator 36 and an extensometer on the cable known as the "deadline" of the drilling draw-works 2.

The electronic central processing unit 41 thus sends, reads, and processes the following signals by performing the following operations:

- sending a management signal S8 to a graphic display 43;
- receiving a return signal from the graphic display 43 for displaying a return signal S9;
- computing the instantaneous speed of penetration of the tool 3 on the basis of the signal S6;
- calculating the instantaneous weight on the tool 3 via the signals S2 and S3;
- managing safety systems and values not to be exceeded for the various drilling parameters;
- computing and controlling the servo-control of the actuation means 32 via the signal S7; and
- determining the angular position of the kelly relative to the vertical.

The limits not to be exceeded are transmitted by the return signal S9 and may include:

- the maximum speed of penetration of the tool 3 into the ground S; and/or
- the maximum torque withstood by the tool 3 in rotation; and/or
- the maximum weight supported by the tool 3.

The graphic display 43 makes it possible to view in digital, bar chart, or galvanometer form, all or some of the various signals S1, S2, S3, S4, S5, S6, S7, S8, S9 in real time.

Potentiometer settings B1, B2, B3, B4 are accessible on the bottom of the color display 43 for the limits of certain parameters and auxiliary controls. These potentiometer settings make it possible to define the various limits not to be exceeded. These settings also make it possible to define the targets for weights on the tool and/or the target for differential mud pressure on the tool.

In automatic drilling, the central processing unit 41 takes control of the actuation means 32 in association with the second brake control handle 33.

Thus, the device 40 is designed to control borehole drilling in such a manner as to obtain:

- greater efficiency and less wear on the drill tool 3;
- greater quality for the walls of the borehole so as to reduce the risk of jamming while the casing 11 is descending;
- monitoring of the maximum rotation torque and of the speed of penetration so as to avoid drilling incidents such as destruction of the drill tool.

The electronic control means 41 are arranged to servo-control the actuation means 32 to a setpoint speed of movement of the end 30 of the brake lever 24. Speed servo-control enables the operator to feel sensations close to the ones the operator feels with manual drilling. This applies in a braking mode for braking the cable C, and in an unwinding mode for unwinding said cable C. The braking mode is defined as an operating mode of the device 40 of the invention, in which operating mode the brake bands 25*a*, 25*b* act on the drum 21 to exert a braking force. In this mode, the device 40 of the invention partially prevents rotation of the drum 21. The braking force may be such that the rotation of the drum 21 is stopped.

The device 40 further includes an emergency stop device of the kill switch or panic button type having the function of interrupting any servo-control of the control lever 40, and of thereby enabling operation of the control lever 40 to go over to purely manual operation.

In a variant of this first servo-control variant, the electronic control means 41 are arranged to servo-control the actuation means 32 to a setpoint thrust force in a braking mode.

In yet another variant of the servo-control, the electronic control means 41 are arranged to servo-control the actuation means 32 to a setpoint position of the control lever 24.

The actuation means 32 are powered via an uninterruptible power supply 44 including means for detecting any interruption in the electrical power supply. The electronic means 41 are configured to control the actuation means 32 so as to actuate them in the braking direction whenever power supply interruption is detected by the power supply interruption detection means. Naturally, the braking direction is the direction in which the device 40 of the invention partially prevents rotation of the drum 21.

In a second embodiment (not shown and described only insofar as it differs from the first embodiment of the control device 40) may alternatively or also include a strain sensor for measuring strain on the second control handle 33. This strain sensor may, for example, be implemented by a strain gauge.

A method is also proposed for controlling a brake control for controlling the brake 23 of a drum 21 of a draw-works 2 equipping a drilling rig 1 operating a drill tool 3 in a borehole P, which method implements a brake control 40 as described above. The brake control 40 includes a brake lever 24 having a first end 29 connected mechanically to brake bands 25*a*, 25*b* designed to act on the drum 21, and a second end 30 provided with a first brake control handle 31.

The method comprises:

- applying a mechanical force on said brake lever 24, the force applied being controlled to procure servo-control of the position of the brake lever 24 and/or of a thrust force exerted on the brake lever 24;
- generating a control signal S7 for servo-controlling the position and/or the thrust force, on the basis of a second control handle 33 disposed substantially at the second end 30 of the brake lever 24; and
- servo-controlling the brake lever 24 procured by an actuator 32 controlled from an electronic control unit 41 arranged to process the control signal S1 generated on the basis of the second control handle and/or of the information relating to the operating conditions of the draw-works 2;
- the information processed by the electronic control unit 41 comprising information relating to the weight applied to the drill tool 3 and/or to the differential mud pressure at the drill tool 3 and/or to the maximum torque in rotation withstood by the drill tool 3 and/or to the maximum speed of penetration of the tool into the ground.

Naturally, the invention is not limited to the above-described examples and numerous changes can be made to these examples without going beyond the ambit of the invention.

For example, in various variants that may optionally be mutually combined:

1) some and/or all of the information collected by the central processing unit 41 may be transferred to a control centre that is remote from the rig 1. The signal relating to the information collected may, for example, by transport via the Internet to an expertise center via a cable or satellite link.

2) an added control signal for controlling the actuation means 32 via the central processing unit 41 may come from a control center remote from the rig 1. The added signal may, for example, be transported via the Internet.

3) the hand of an operator may advantageously be replaced by any article arranged to exert a force and/or a pressure on the second control handle 33. For example, such an article may be an actuator on the control handle and that is controlled remotely.

4) the signals S2 and S3 may advantageously be used respectively to read the instantaneous weight on the drill tool 3 and to read the parameter for the desired weight on the drill tool, i.e. the target weight on the drill tool that will have been set by the operator via a knurled wheel included in the indicator 36. In which case, the operator sets the target weight via the knurled wheel of the indicator 36 and not via the potentiometer settings. The same change may be made to a device indicating the differential mud pressure.

The invention claimed is:

1. A device for controlling a brake of a drum of a draw-works equipping a drilling rig operating a drill tool in a borehole, the device comprising:

a brake lever having a first end connected mechanically to brake bands designed to act on said drum and a second end provided with a first brake control handle, said device further comprising actuation means configured to be controlled and arranged to act mechanically on said brake lever, and a second brake control handle arranged to servo-control said actuation means and electronic means configured to control the actuation means, on the basis of a control signal emitted by the second brake control handle and/or of information on weight conditions to which the drill tool is subjected; wherein the second brake control handle incorporates an extensometer sensor arranged to generate a handle control signal sensitive to the pressure exerted on said second brake control handle by the hand of an operator.

2. The device according to claim 1, wherein the electronic control means are arranged to servo-control the actuation means to a setpoint thrust force in a braking mode.

3. The device according to claims 2, wherein the electronic control means are arranged to servo-control the actuation means to a setpoint position of the brake lever.

4. The device according to claim 3, wherein the actuation means are powered via an uninterruptible power supply including power supply interruption detection means, the electronic control means being configured to control said actuation means to actuate the actuation means in the braking direction when a power supply interruption is detected by said power supply interruption detection means.

5. The device according to claim 4, wherein the actuation means are arranged so that, when the brake lever is in a given position, the braking force applied by said actuation means increases when the force exerted by the drill tool on the cable wound on the draw-works increases.

6. The device according to claim 5, wherein the actuation means comprise an electric actuator.

7. The device according to claim 6, wherein the actuation means comprise a torque motor.

8. A method of controlling a brake control for controlling a brake of a drum of a draw-works equipping a drilling rig operating a drill tool in a borehole, which method implements a brake control, said brake control comprising a brake lever having a first end connected mechanically to brake bands designed to act on said drum and a second end provided with a first brake control handle, said method comprising:

applying a mechanical force to said brake lever, said applied force being controlled to procure servo-control of the position of said brake lever and/or of a thrust force exerted on said brake lever;

controlling actuation means, on the basis of a control signal emitted by a second brake control handle and/or of information on weight conditions to which the drill tool is subjected; wherein the second brake control handle incorporates an extensometer sensor; and generating a handle control signal sensitive to the pressure exerted on said second brake control handle by the hand of an operator.

9. The method according to claim 8, further comprising:

generating a control signal for servo-controlling the position and/or the thrust force, on the basis of a second control handle disposed substantially at the second end of the brake lever.

10. The method according to claim 9, wherein the servo-control of the brake lever is procured by an actuator controlled from an electronic control unit arranged to process the control signal generated on the basis of the second control handle and/or of the information relating to the operating conditions of the draw-works.

11. The method according to claim 10, wherein the information processed by the electronic control unit comprises information relating to the weight applied to the drill tool.

12. The method according to claim 11, wherein the information processed by the electronic control unit comprises information relating to the differential mud pressure at the drill tool.

13. The method according claim 12, wherein the information processed by the electronic control unit comprises information relating to the maximum torque in rotation withstood by the drill tool.

14. The method according to claim 13, wherein the information processed by the electronic control unit comprises information relating to the maximum speed of penetration of the drill tool into the ground.

* * * * *